US008702104B2

(12) United States Patent
Legary et al.

(10) Patent No.: US 8,702,104 B2
(45) Date of Patent: Apr. 22, 2014

(54) AMUSEMENT APPARATUS WITH PARTICIPANT-CONTROLLED TARGET BLOCKER AND ELECTROMAGNETICALLY CONTROLLED DUMPING DEVICE

(76) Inventors: Brian Legary, Grande Pointe (CA); James Legary, Grande Pointe (CA)

( * ) Notice: Subject to any disclaimer, the term of this patent is extended or adjusted under 35 U.S.C. 154(b) by 165 days.

(21) Appl. No.: 13/293,815

(22) Filed: Nov. 10, 2011

(65) Prior Publication Data

US 2013/0119610 A1 May 16, 2013

(51) Int. Cl.
*F41J 5/14* (2006.01)
*A63B 63/00* (2006.01)

(52) U.S. Cl.
USPC ..... 273/384; 273/371

(58) Field of Classification Search
USPC ..... 273/349, 350, 383–385, 440, 457, 389, 273/357; 472/128
See application file for complete search history.

(56) References Cited

U.S. PATENT DOCUMENTS 3,456,947 A * 7/1969 Borgford ..... 273/440
3,592,468 A * 7/1971 Simendinger, Jr. ..... 463/47.1
3,731,932 A * 5/1973 Breslow et al. ..... 273/384
3,843,127 A * 10/1974 Lack ..... 273/349
4,093,228 A 6/1978 Pierce
4,702,480 A 10/1987 Popeski
4,909,518 A * 3/1990 Erlandson et al. ..... 273/357
5,087,054 A 2/1992 O'Neil
5,480,147 A 1/1996 Ethier et al.
5,482,292 A 1/1996 Stone
5,586,767 A * 12/1996 Bohland ..... 273/349
5,611,460 A * 3/1997 Rudell ..... 222/78
5,634,642 A 6/1997 Grandolfo
5,779,240 A * 7/1998 Santella ..... 273/349
5,848,793 A 12/1998 Celis
5,855,372 A 1/1999 Thiemann
5,938,204 A * 8/1999 Tzeng et al. ..... 273/440
5,992,853 A 11/1999 Rudell
6,102,404 A 8/2000 Barker
6,210,287 B1 * 4/2001 Briggs ..... 472/128
6,264,201 B1 7/2001 Holsten
6,296,252 B1 10/2001 Hubka
6,786,830 B2 * 9/2004 Briggs et al. ..... 472/128
7,316,400 B1 1/2008 Holsten
8,282,498 B2 * 10/2012 Publicover et al. ..... 472/118

* cited by examiner

*Primary Examiner* — Mark Graham
(74) *Attorney, Agent, or Firm* — Kyle R. Satterthwaite; Ryan W. Dupuis; Ade & Company Inc.

(57) ABSTRACT

An amusement game or attraction for two or more participants features at least one target device arranged to provide an output in response to impact of a target member of said target device by a projectile launched by a first participant, an effect device arranged to be activated by the target device to produce a physical effect on at least one participant, and a blocking device operable by a second participant and comprising a blocking member movable relative to said target by input from the second participant to attempt to block the projectile from impacting the target member. The game or attraction offers an added level of interaction for the second participant compared to previous games where the second participant gas no active role, and just awaits the potential outcome of a target strike by the first participant. The effect device may be a unique electromagnetically controlled bucket dumping device.

17 Claims, 7 Drawing Sheets

AMUSEMENT APPARATUS WITH PARTICIPANT-CONTROLLED TARGET BLOCKER AND ELECTROMAGNETICALLY CONTROLLED DUMPING DEVICE

FIELD OF THE INVENTION

The invention generally relates to interactive amusement games and attractions. More specifically it relates to amusement games comprised of target-triggered water dousing assemblies, wherein at least one participant launches or throws a projectile at a framework with one or more targets affixed thereto such that the projectile may strike the targets to cause dousing of another participant with water.

BACKGROUND OF THE INVENTION

Amusement games and portable amusement games have included target triggered dousing assemblies for years, in the form of dunk tanks, water balloon bursting games, and the like.

A brief summary of prior art patents relating to the general field of water-based amusement includes U.S. Pat. No. 4,093,228—Water dumping target game, Filed: Jun. 27, 1977, Issued: Jun. 6, 1978; U.S. Pat. No. 4,702,480—Flushing booth target apparatus, Filed: Apr. 7, 1986, Issued: Oct. 27, 1987; U.S. Pat. No. 5,087,054—Amusement dunking apparatus, assigned to Dunk The Clown, Inc., Filed: Mar. 14, 1991, Issued: Feb. 11, 1992; U.S. Pat. No. 5,482,292—Dumping toy, Filed: Jan. 30, 1995, Issued: Jan. 9, 1996; U.S. Pat. No. 5,634,642—Water dumping game with adjustable target, Filed: Jul. 1, 1996, Issued: Jun. 3, 1997; U.S. Pat. No. 5,848,793—Water game, Filed: Aug. 22, 1997, Issued: Dec. 15, 1998; U.S. Pat. No. 5,855,372—Water target game, Filed: May 11, 1998, Issued: Jan. 5, 1999; U.S. Pat. No. 5,992,853—Game with timed water release, Filed: Mar. 2, 1998, Issued to Elliot A. Rudell Nov. 30, 1999; U.S. Pat. No. 6,102,404—Target triggered dousing assembly, Filed: Apr. 8, 1999, Issued: Aug. 15, 2000; U.S. Pat. No. 6,264,201—Water balloon game, Filed: Aug. 4, 2000, Issued: Jul. 24, 2001; U.S. Pat. No. 6,296,252—Water game systems and methods, Filed: Apr. 20, 2000, Issued: Oct. 2, 2001; and U.S. Pat. No. 7,316,400—Water pumping game apparatus, Filed: Nov. 13, 2006, Issued: Jan. 8, 2008.

Known amusement games and attractions of the type referenced above are highly one-sided in terms of participant control over the outcome of the game, as one participant launches the projectiles while the other participant simply awaits the possible outcome associated with the first participant's successful impact of a target.

Accordingly, there remains room for improvement in these types of games and attractions.

SUMMARY OF THE INVENTION

According to a first aspect of the invention there is provided an amusement apparatus for use by at least two participants, the apparatus comprising:

at least one target device arranged to provide an output in response to impact of a target member of said target device by a projectile launched by a first one of said participants;

an effect device arranged to be activated by the output of the target device to produce an output action having a physical effect on at least one of said participants; and a blocking device operable by a second one of said participants and comprising a blocking member movable relative to said target by input from the second one of said participants to enable said second one of said participants to attempt to block the projectile from impacting the target member.

The apparatus improves the entertainment value over prior art amusement games and attractions by adding an interactive element for the second participant, particularly a means of blocking a projectile, which takes these games to an even higher level of participation and interaction.

Preferably there is provided a framework on which said blocking device is mounted. The second participant may be located behind or beside the framework and using a blocking device, attempt to stop the projectiles from successfully striking the targets. Should a target be successfully hit, an outcome will be triggered, which may include the dumping of a bucket of water, a spray or misting of water, dunking of the participant in water, dropping of the participant in a foam pit, a directed blast of air, a shower of confetti, or other effect performing a physical action on one or more participants.

Preferably said at least one target is mounted on the same framework as the blocking device.

Preferably the blocking device comprises an input member to be manipulated by the second one of said participants and the framework comprises a barrier positioned between the at least one target and the input member to protect the second one of said participants from the projectile when launched toward the target by the first one of said participants.

Preferably at least a portion of the barrier provides a viewing window through which the second one of said participants can visually monitor approach of the projectile.

Preferably the viewing window comprises a covering spanning across a frame of the window, the covering having openings sized to prevent passage of the projectile therethrough while allowing viewing through the covering.

Preferably the covering comprises a mesh material.

Preferably the effect device is arranged to provide the physical effect at a location on a same side for the framework as the input member of the blocking device.

Preferably said effect device is mounted on the same framework as the blocking device.

Preferably the blocking member is pivotally mounted on the framework.

Alternatively, the blocking member may be slidably mounted on the framework.

Preferably the blocking device comprises an input member to be manipulated by the second participant, and the blocking member is mechanically connected to the input member.

Alternatively, the blocking device may comprise an input member to be manipulated by the second participant, with the blocking member being movable by an actuator that is electrically linked to the input member to receive control signals therefrom.

Preferably the target device comprises a switch actuable to effect the output in response to contact of the target member by the projectile.

Preferably said at least one target comprises multiple targets and the blocking member is movable between different positions blocking different ones of said multiple targets.

Preferably there is provided an electronic control system coupled between the effect device and the target device, wherein the effect device comprises an electronically controlled dumping assembly comprising a container arranged to release contents therefrom under the output of the target device.

Preferably the container comprises a closed bottom and an opening positioned at a height above said closed bottom when the container is in a normal upright position, the output of the target device changing an electromagnet between on and off states to tilt the container out of the normal upright position into a dumping position releasing the contents of the container.

Preferably the electromagnet is arranged to maintain the container in its upright position when in the on state.

Preferably the container is gravitationally biased out of the upright position toward the dumping position when the bucket is filled to at least a predetermined level.

Preferably there is provided a return spring arranged to bias the container toward the upright position.

Preferably there is provided a normally closed valve arranged for connection to a source of liquid and connected to the electronic control system to automatically fill the container with liquid content.

According to a second aspect of the invention there is provided an amusement method for operating an amusement apparatus for at least two participants, the amusement apparatus comprising at least one target device operable to trigger an effect when a target member of the target device is impacted by a projectile, the method comprising the steps of:

providing a first one of said participants with access to one or more projectiles;

providing a second one of said participants with access to a blocking device operable in an attempt to stop said one or more projectiles from reaching said at least one target device when launched by the first one of said participants; and generating an output action at the effect device in response to impact of the target to produce a physical effect on at least one of said participants.

According to a third aspect of the invention there is provided an amusement apparatus for use by at least two participants, the apparatus comprising:

at least one target device arranged to provide an output in response to impact of a target member of said target device by a projectile launched by a first one of said participants;

an effect device arranged to be activated by the output of the target device to produce an output action having a physical effect on at least one of said participants; and an electronic control system coupled between the effect device and the target device;

wherein the effect device comprises an electronically controlled dumping assembly comprising a container arranged to release contents therefrom under the output of the target device, the container comprising a closed bottom and an opening positioned at a height above said closed bottom when the container is in a normal upright position, the output action of the target device changing an electromagnet between on and off states to tilt the container out of the normal upright position into a dumping position releasing the contents of the container.

According to a fourth aspect of the invention there is provided an amusement game/attraction comprising:

a support framework;

a blocking mechanism;

a singular or multiple target assemblies disposed proximate the framework and arranged to provide an output action in response to an input action taken upon the target by a projectile; and a water effect device arranged to be activated by the output action of the target to produce a water effect.

The blocking assembly may be comprised of a mechanical pivoting arm, a mechanical sliding arm, or an electronically maneuverable arm or lever.

The target may be wired to an indicator that is arranged to intermittently activate to signal the participants to attempt to take the input action on the target and the target is arranged to provide the output action in response to the input action only if the input action is taken upon the target while the indicator is activated.

The indicator preferably comprises a visual indicator providing a visual signal at a position viewable by the participants.

Preferably the indicator comprises a light situated at a position viewable by the participants.

The target may comprise a switch actuable to effect the output action by a projectile coming in contact with the target.

Alternatively the target may comprise a sensor operable to detect presence of a projectile proximate the target and effect the output action in response thereto.

There may be provided a sound device arranged to convey audible signal in response to the input action taken on the target.

There may be provided an electronic control system arranged to activate a water dousing assembly in response to the input action at the target and also activate a water control device for feeding said water dousing assembly.

There may be provided an electronic control system arranged to activate the water control device in response to the input action at the target, the control system comprising a timer arranged to time a game length of the attraction and being arranged to start the timer in response to an operator input and produce a visual or audible game expiry signal at the expiry of the timer.

An indicator light may be affixed to the support framework to provide a visual indication that the target(s) are active.

The target is preferably disposed on the front of the support framework.

There may be provided multiple ones of the target.

The water effect device may comprise an electromagnetic dumping assembly with a water container communicable with a water source to receive a predetermined amount of water in the container under each communication thereof with the water source and a normally closed water valve openable to communicate a pressurized water source to the container by means of a hose, the electromagnet dumping assembly being arranged to release under the output action of the target to expose the water in the container through the open end thereof and dump upon a game participant.

The water effect device may further comprise a normally closed water valve openable to communicate the water source with a passage to deliver the predetermined amount of water thereto, with the amusement attraction further comprising an electronic control system arranged to open the normally closed water valve in response to the input action at the target and then, direct the water at the game participant.

According to a fifth aspect of the invention there is provided an amusement method for an amusement game/attraction comprising a support framework with singular or multiple targets, disposed in a manner such that a blocking mechanism may be operated by a game participant to stop a projectile from hitting the target(s), the method comprising the steps of:

providing a target and a water effect device at positions proximate the support framework;

allowing a participant to maneuver a blocking mechanism in an attempt to stop an input action upon the target by a launched projectile; and generating a water effect at the water effect device in response to the input action on the target to produce a water effect.

BRIEF DESCRIPTION OF THE DRAWINGS

In the accompanying drawings, which illustrate an exemplary embodiment of the present invention.

DETAILED DESCRIPTION

Figure 1A:
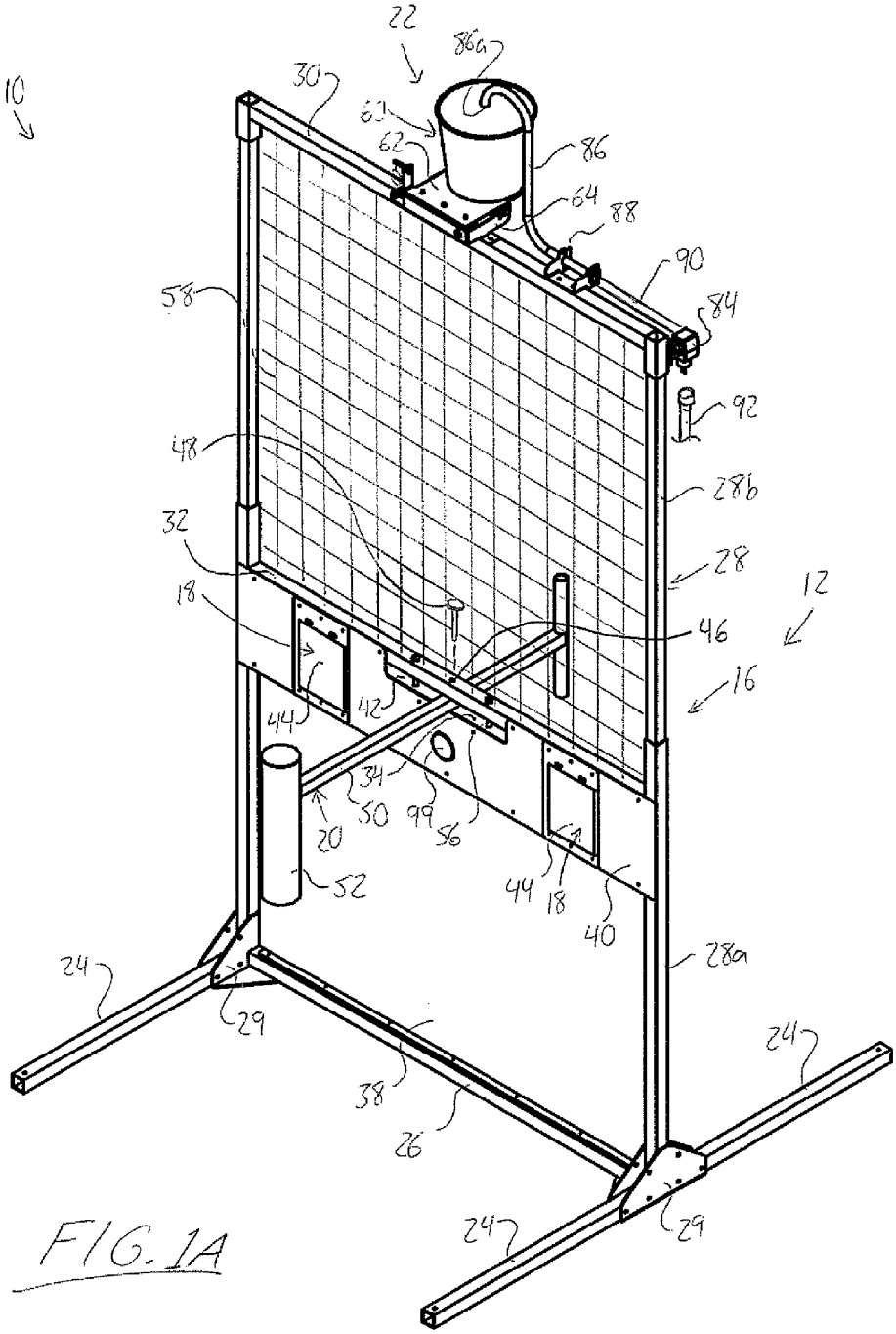
FIG. 1A is a top, front, side perspective view of an amusement apparatus for target-triggered water dousing of a first participant by launching of projectiles by a second participant, wherein a projectile blocking device adds a degree of active participation for the first participant.
Figure 1B:
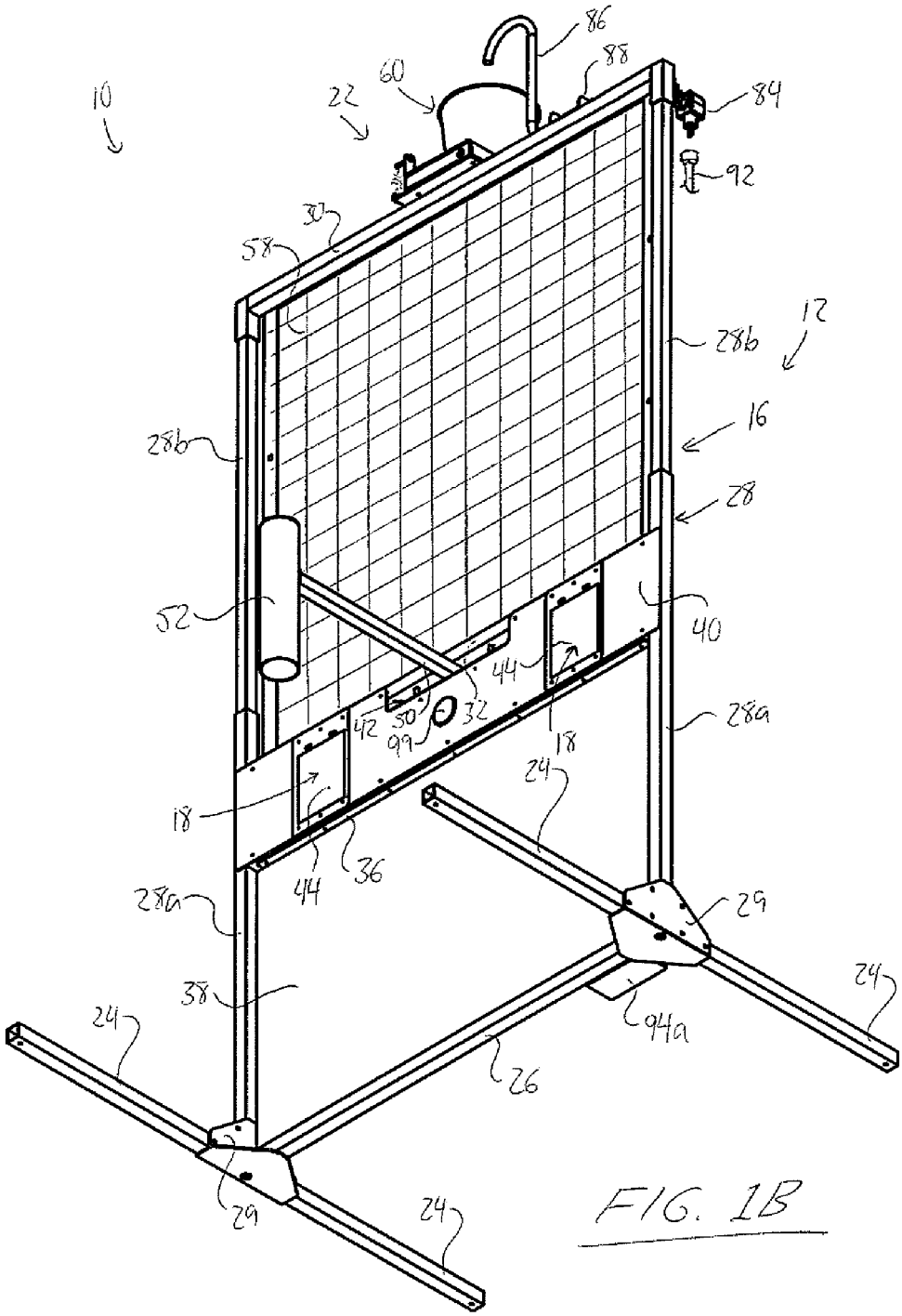
FIG. 1B is a bottom, front, side perspective view of the amusement apparatus of FIG. 1A.
Figure 2:
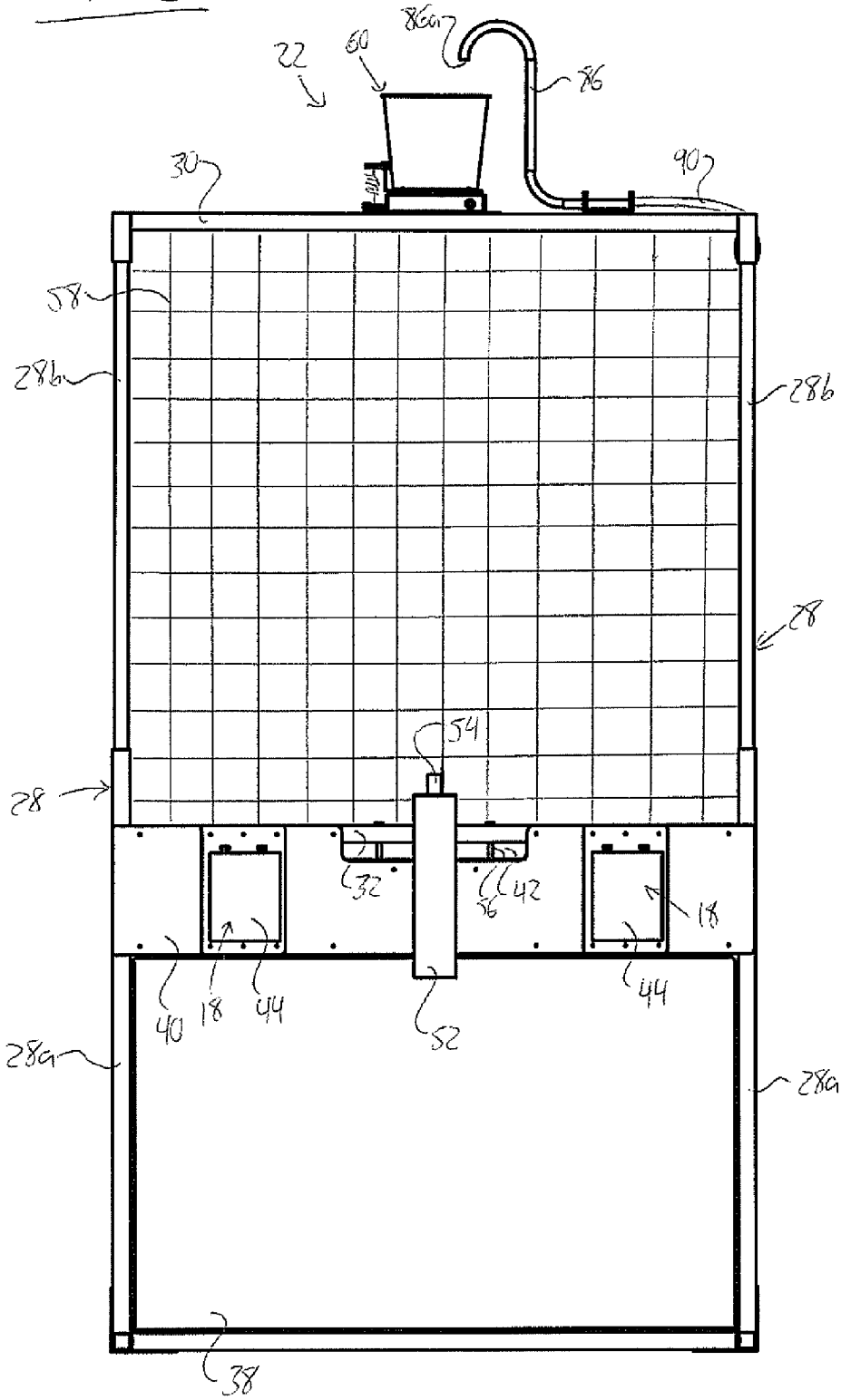
FIG. 2 is a front elevational view of the amusement apparatus of FIG. 1.
Figure 3:
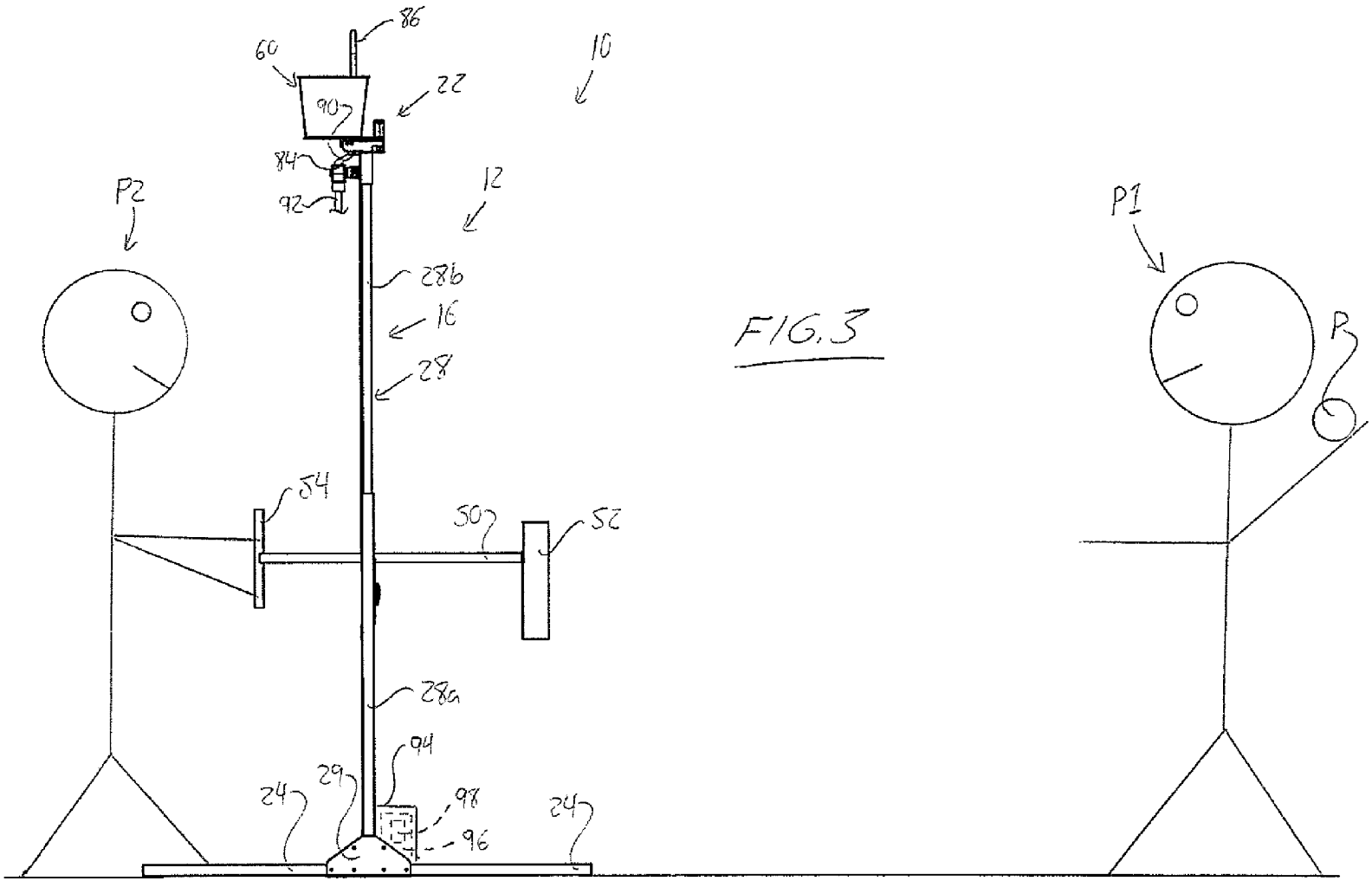
FIG. 3 is a side elevational view of the amusement apparatus of FIG. 1 during use.
Figure 5:
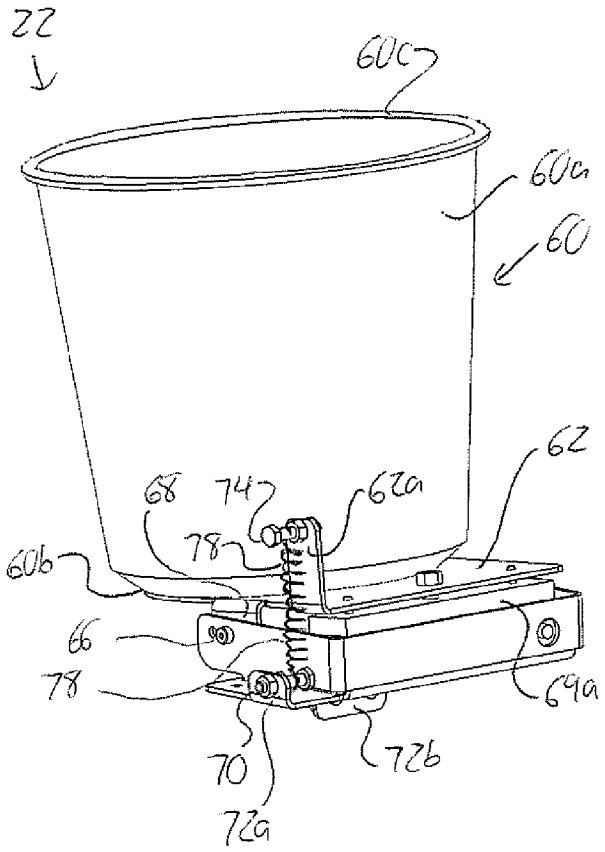
FIG. 5 is a front side perspective view of the water dumping assembly of the apparatus of FIG. 1.
Figure 4:
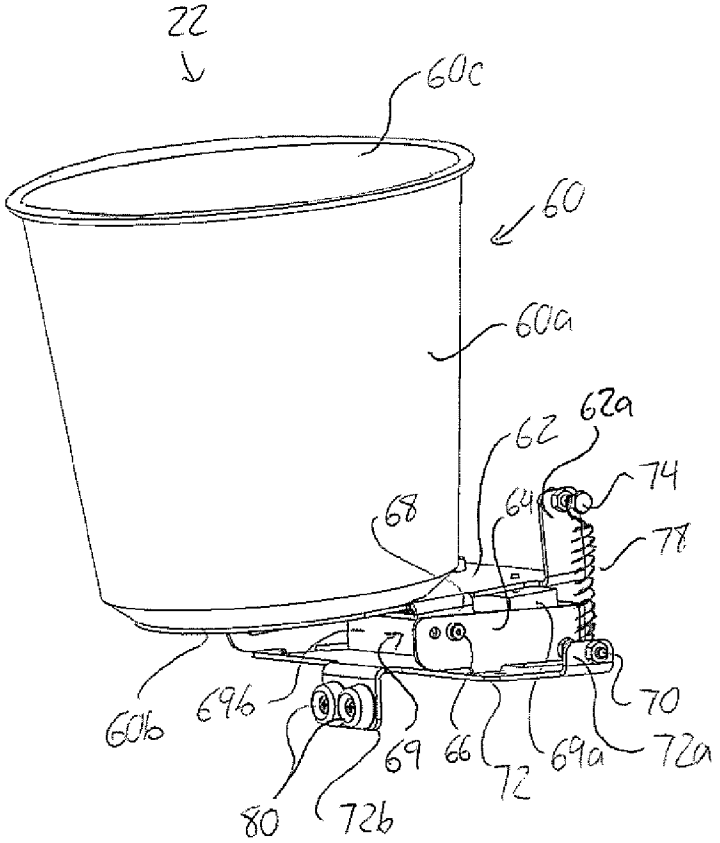
FIG. 4 is a rear side perspective view of a water dumping device of the apparatus of FIG. 1.
Figure 7:
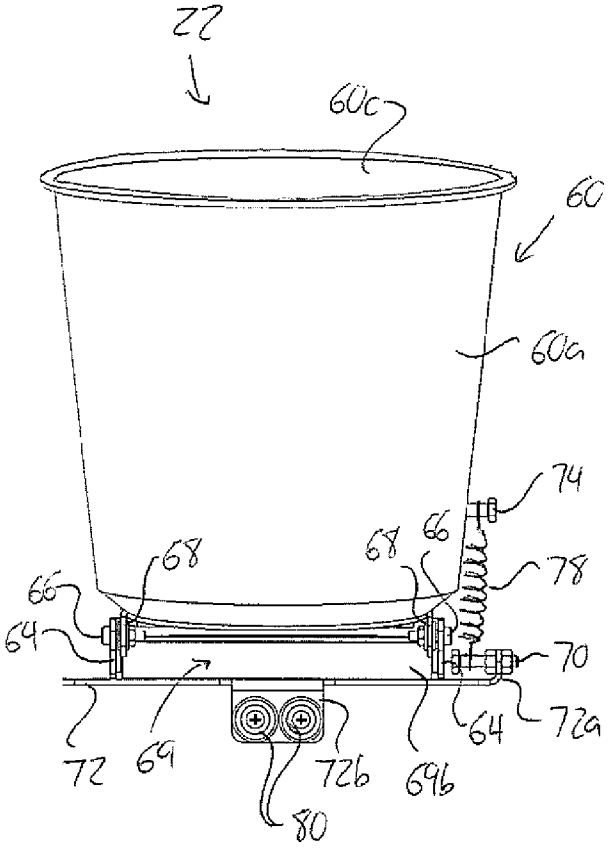
FIG. 7 is a rear elevational view of the water dumping assembly of the apparatus of FIG. 1.
Figure 6:
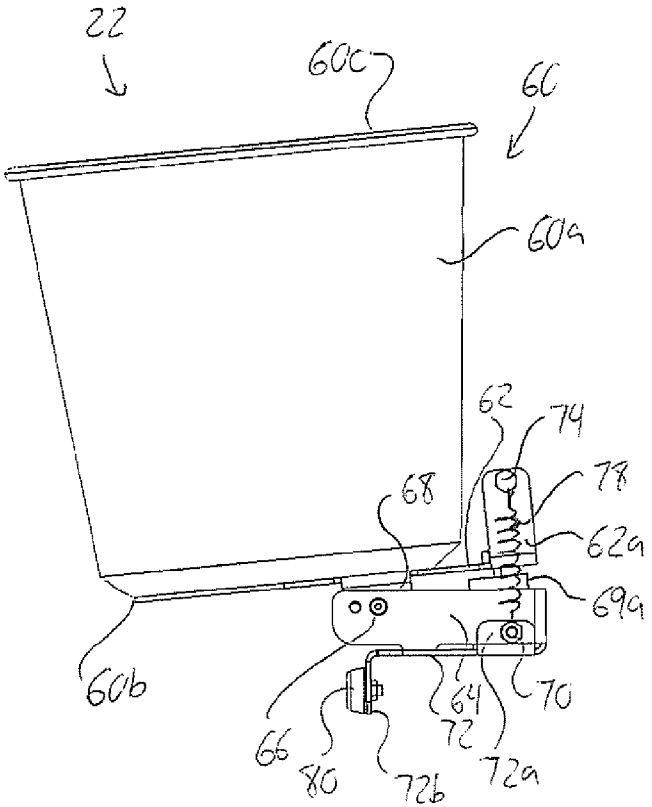
FIG. 6 is a side elevational view of the water dumping assembly of the apparatus of FIG. 1.

FIGS. 1 to 3 show a water amusement game apparatus 10 according to one embodiment of the present invention. The apparatus features a frame 12 having a horizontal base portion 14 and a vertical upright portion 16, a pair of targets 18 and a movable blocking mechanism 20 mounted on the upright portion 16 at an intermediate height therealong, and a water dumping assembly 22 mounted atop the upright portion 16 of the frame 14. The frame 12 defines a physical barrier between a first participant P1, who stands at a distance in front of the frame, and a second participant who stands behind the frame in a position closer thereto. The dumping assembly 22 is arranged to dump a bucket of water on the second participant P2 behind the frame 12 if one of the targets 18 is hit by a projectile P thrown by the first participant, such as a water soaked foam ball, or other projectile, wet or dry, ball-shaped or not. A new level of interaction is provided over the prior art through the blocking mechanism 20, which is controlled by the second participant and operable to try and block the projectile from hitting either target 18.

The frame of the illustrated embodiment is constructed from rectangular metal tubing. The base portion 14 features four tubular members 24 that define feet of the overall framework. These foot members 24 are of equal length to one another and are arranged in two pairs, each pair featuring two feet 24 aligned with one another and the two pairs extending parallel to one another at horizontally spaced positions. A fifth tubular member 26 extends perpendicularly between the two pairs of feet 24 to define a cross-member of the base 14 at a central location therealong where the two feet 24 of each pair are slightly spaced apart in an end-to-end configuration.

The upright portion 16 of the frame features two tubular uprights 28 of equal height, each extending vertically upward from between the two feet 24 at the respective side of the base 14. In the illustrated embodiment, brackets 29 interconnect the foot tubes 24 and cross member 26 of the base 14 and connect the same to the uprights 28 and the lower cross-member 26. A top tubular cross member 30 perpendicularly connects the two uprights 28 at the top ends thereof. Three parallel intermediate tubular cross members 32, 34, 36 perpendicularly connect the two uprights 28 at spaced apart intermediate positions therealong. A lower rectangular plate 38 spans fully between the two uprights 28 from the base cross member 26 up to the lowermost member 36 of the three intermediate cross members 32, 34, 36. A front cover plate 40 is mounted over the three intermediate cross members 32, 34, 36 on the front side of the frame (i.e. the side closest to the viewing pane of FIG. 1) to fully span between the two uprights 28 and fully span from the lowermost intermediate cross member 36 to the uppermost intermediate cross member 32, except for at a central rectangular slot 42 left open between the uppermost and middle intermediate cross members 32, 34 at a central position therealong. This slot is created by a rectangular cutaway in the otherwise linear top edge of the cover plate 40 at a central location along this edge.

A target pad 44 of each target assembly 18 is positioned in front of the cover plate 40 to face outwardly from the plane of the upright portion 16 of the frame and is coupled to, or forms part of, a pressure switch. When a projectile thrown by the first participant from in front of the apparatus impacts the target pad 44 of one of the target assemblies 18, this closes the pressure switch, which sends a signal to a control system or control module described herein further below. The two target assemblies 18 are horizontally spaced apart along the plane of the cover plate 40 to reside past opposite ends of the rectangular slot 42. At a central point along the uppermost and middle intermediate cross-members 32, 34, a vertical bore 46 passes fully therethrough for receipt of a pivot pin 48 therein from above the intermediate cross-members 32, 34, 36.

The blocking mechanism 20 features a central arm member 50 in the form of a piece of rectangular metal tubing passing through the rectangular opening or slot 42 between the upper and middle intermediate cross-members 32, 34 of the frame's upright portion 16. A blocking member 52 is fixed to an end of the central arm member 50 in front of the frame's upright portion 16, and an operator input member 54 is fixed to the opposite end of the central member 50 behind the frame's upright portion 16. A vertical through-bore in the central arm member 50 aligns with the vertical through-bore 46 in the upper and middle intermediate cross members 32, 34 of the upright portion 14 of the frame, so that the pivot pin 48 passes vertically through the central member 50 to pivotally carry the central member 50 on the upright portion of the frame. The central member 50 can thus pivot in a horizontal plane about the pivot pin axis that resides at the center of the rectangular slot 42 in the upright portion of the frame.

The second participant standing behind the upright portion 14 of the frame can thus manually grip the input member 54 and shift the same horizontally back and forth relative to the frame 12 in the cross-wise direction thereof to move the blocking member 52 back forth in front of the upright portion of the frame. The length by which the central member 50 projects forward from the upright portion of the frame and the allowed angular range of the central member's pivotal motion are sufficient to ensure that the blocking member's range of motion spans from a blocking position in front of one of the target pads 44 to another blocking position in front of the other target pad. Under this pivotal operation of the illustrated blocking mechanism, the second participant thus moves the blocking member 52 toward a select one of the target pads 18 in front of the frame uprights by shifting the input member 54 toward the opposite target 18 behind the frame uprights.

In the illustrated embodiment, the maximum extent of the blocking member movement in either lateral direction from the cross-wise center of the frame is defined by stop pins 56 received in a pair of vertical bores found in the upper and middle intermediate cross-members 32, 34 of the frame on opposite sides of the central vertical bore 46 therein at positions spaced from this central bore 46 within the rectangular slot 42. In other embodiments, the stops for limiting movement of the blocking mechanism by contact with the central member 50 thereof may alternatively be formed by the opposing ends of the rectangular cutaway in the top edge of the frame's cover plate 40. The stops may be positioned such that the maximum angular displacement of the central member 50 in either direction from a centered position perpendicular to the plane of the frame uprights acts to position the blocking member in a blocking position in front of the respective target pad 44, or may instead be positioned to allow further movement acting to move the blocking member past such a blocking position, thereby increasing the challenge to the second participant by requiring more careful control of the blocking mechanism to suitably position the blocking member at a location blocking one of the targets.

For example, in the illustrated embodiment, the stop pins 56 limit the angular range of the blocking mechanism to movement of the of the blocking member between two blocking positions in front of the two targets 18, while removal of the stop pins 56 extends the angular range so that movement is instead limited by contact of the central member with the ends of the rectangular cutaway/slot 42, thereby allowing the blocking member to move laterally outward past either target 18. The owner or operator of the apparatus can thereby select between different difficulty levels of the blocking functionality of the game by selectively installing or removing the stop pins 56. Further selectable challenge levels can be added by increasing the number of bores in which the stop pins can be inserted along the intermediate cross members.

In the illustrated embodiment, the input member 54 of the blocking mechanism 20 is a vertical rod of round section crossing the rear end of the central member 50, whereby the second participant can grip the rod with one or two hands above or below the central member 50, or above and below the central member. The blocking member 52 is also a round cylinder and vertically crosses the central member 50, but is larger in diameter than the input member and extends further downward from the central member than upward therefrom, due to the positioning of the illustrated target pads 44 mostly or entirely below the rectangular slot 42 in which the blocking mechanism pivots. The round cylindrical shape of the blocking member 52 means that the part of the blocking member facing forwardly away from the upright portion 16 of the frame 12 at any given time, regardless of the angular position of the central member 50 relative thereto, will have the same shape and orientation. Accordingly, the blocking member provides the same effective blocking surface when positioned in front of one target 18 as when positioned in front of the other target. The diameter of the blocking member may equal or exceed that width of each target pad, or for a greater blocking challenge, may have a diameter smaller than the target pad width.

The two uprights 28, top cross member 30, and upper intermediate cross-member 32 of the upright frame portion 16 form a window frame delimiting a rectangular opening or viewing window through which the second participant behind the upright frame portion 16 can view the first participant in front of the frame and the approaching projectiles thrown or launched by the first participant toward the targets 18. The viewing window also allows the first participant and observers of the game to witness the dumping of water onto the second participant when one of the targets is struck by a projectile. For the safety of the second participant, the window opening is covered with a transparent, translucent, perforated or mesh-type covering material 58 spanning this window frame so that the projectiles will impact the window covering without reaching the second participant. The lower plate 38 and cover plate 40 similarly spanning across the uprights 28 below the window opening cooperate with the window covering to form a protective barrier over the full height of the frame. Where a perforated or mesh cover is used at the viewing window, the openings are small enough to prevent passage of the projectiles through them, while large enough to provide a high degree of visibility for the second participant. The slot 42 for passage of the blocking mechanism through the upright frame portion is likewise small enough in height to prevent a projectile from passing through it.

Still referring to FIGS. 1 to 3, the dumping mechanism features a bucket 60 fixed atop a base plate 62 supported atop the top cross member 30 of the upright frame portion 16. A pair of support brackets 64 project perpendicularly from the top cross member 30 on opposite sides of a central point therealong to the rear side of the upright frame portion 16. Near the ends of the brackets 64 further from the cross-member 30 on the rear side of the upright frame portion, the base plate 62 is pivotally mounted on the brackets for rotation about a horizontal axis parallel to the cross member 30. In the illustrated embodiment, this pivotal connection is achieved using pivot bolts 66 passing through the brackets 64 and respective downturned flanges 68 on opposite sides of the base plate 62. When the base plate is horizontally positioned, the bucket 60 resides in a vertically upright position in which the circumferential wall 60*a* of the bucket safely contains water between the closed bottom end 60*b* of the bucket and the open upper end 60*c* thereopposite.

At a position between the brackets 64, near the front ends thereof furthest from the pivotal mounting of the base plate 62 thereto, an electromagnet 69 is fixed to the brackets in a position acting to magnetically draw the front end of the base plate downwardly toward the electromagnet when activated, Stop features defined between the base plate and the brackets are arranged to block this downward movement of the plate's rear end past a seated horizontal position of the base plate, in which the bucket is oriented in its upright position. In the illustrated embodiment the seated position stop is defined by contact between a flat bar-shaped piece of ferromagnetic material 69*a* fixed to the underside of the base plate 62 at the front end thereof to form the magnetically attractable portion thereof, and a flat upper wall of a rectangular housing 69*b* of the electromagnet 69 disposed between the front ends of the brackets 64. Laterally outward from one of the brackets 64 near the front end thereof, a first horizontal bolt 70 is fastened to an upturned flange 72*a* at the distal end of a bottom plate 72 that spans between and projects laterally beyond the brackets therebeneath, and on which the electromagnet 69 is mounted. On the same side, a second horizontal bolt 74 is fastened to an upturned flange 62*a* of the base plate 62 at the front end thereof. With the base plate 62 horizontally seated, the second horizontal bolt 74 resides on the same side of the coincident axes of the base plate pivot bolts 66 as the first horizontal bolt 70, with the second horizontal bolt 74 located at an elevation above the first horizontal pivot bolt 70. The horizontal bolts 70, 74 form spring catches around which the hooked or looped ends of a coiled tension spring 78 are engaged.

At a central position between the brackets 64, the bottom plate 72 features a downturned flange 72*b* at the rear end thereof situated near the pivot bolts 66 and the rear ends of the brackets. On the rear facing side of this flange 72*b* are a pair of rubber pads 80 against which the base plate 62 will abut under sufficient pivoting of the base plate 62 out of its normal horizontally-seated position into or past a vertical orientation ninety degrees from the seated position. Abutted against these stop pads 80, the base plate 62 has thus reached or passed a vertical orientation in which the bucket 60 is horizontally oriented. Such tilting of the bucket 60 from its default upright position into or past a horizontal orientation will thus dump the contents of the bucket through the open end thereof behind the upright portion 16 of the apparatus frame, thereby dousing the second participant with water.

The operation of the dumping mechanism is as follows. The central axis of the bucket 60 is located behind the shared axis of the support plate pivot bolts 66, and so the weight of the bucket, the portion of the support plate therebeneath and any contents found in the bucket tend to pivot the base plate out of its seated horizontal position toward the stop position in which it abuts against the pads 80. That is, the bucket is gravitationally biased out of its upright position toward a water dumping position. However, the tension spring 78 resists any upward movement of the plate's front end from the seated position, thereby resisting movement of the bucket toward the dumping position. The strength of spring is selected to be sufficient to overcome the bucket-tipping tendency when the bucket is empty, thereby maintaining the empty bucket in the upright position and returning the bucket to such a position after any dumping of its contents, but insufficient for the spring to alone maintain the bucket in the upright orientation once the bucket has been filled with a predetermined volume of water. Once the bucket has been filled to this level or above, the spring alone cannot keep the bucket upright. However, the electromagnet is defaulted to an 'on' state emitting a magnetic field to attract the front end of the seated base plate, and the strength of this magnetic attraction is sufficient to counteract the combined tipping tendency of the bucket an its contents. The electromagnet preferably has a strength exceeding that which is required to hold the bucket upright when the bucket is completely filled to its upper end, thereby ensuring that no accidental tipping will take place even if the bucket is filled beyond a recommended level that is known to be sufficient to overcome the tension spring when the electromagnet is off.

Accordingly, under the combined action of the electromagnet and the tension spring, the filled bucket remains in the upright condition so long as the electromagnet remains active. However, when the first participant successfully strikes one of the targets with a projectile, the electromagnet is deactivated, thereby allowing the gravitationally-induced dumping of the bucket to take place, thereby dumping the bucket contents on the second participant. With its contents emptied by this dumping action, the bucket is then returned to the upright position through the return action provided by the tension spring. The electromagnet is activated again so as to maintain the upright position of the bucket through a subsequent re-filling of the bucket until a next impact occurs at one of the targets.

The illustrated embodiment also employs an automatic bucket refill device 82, which features an electronically controlled valve 84 fixed to one of the frame uprights 28 near the top end thereof and a rigid fill pipe 86 fixed atop the top cross-member 30 of the upright frame portion 16. The refill pipe 86 has its outlet end 86*a* positioned to lie above the open top 60*c* of the bucket 60 when in its normal upright position. In the illustrated embodiment, the pipe features a combination of linear and curved sections arranged to position the outlet end in this manner relative to an inlet end at a lower position carried on the top cross member 30 by a suitable bracket 88. A length of flexible hose 90 connects the outlet of the valve 84 to the inlet of the fill pipe, and the input of the valve is configured for coupling to a pressurized water source, for example by threaded connection of a conventional garden hose 92 to the valve.

For portable versions of the apparatus, a rechargeable battery is preferably employed as the power source for the electronic components of the system. A power supply for converting A.C. mains power to D.C. power and stepping down the voltage may be employed to allow mains power to be selectively in place of the battery of such a portable unit. FIG. 3 illustrates a water proof housing or box 94 mounted on the base 12 of the frame on a mounting plate 94*a* at the corner between the cross member 26 and one set of feet 24 to house a battery 96 and a control module 98 of the apparatus. Alternatively, less portable units intended for long-term use or permanent installation may employ mains power as an exclusive power source for operating the electronic components of the apparatus. The illustrated embodiment features a status indicator 99 mounted in a position on the front side of the frame visible to the first participant. The status indicator is used to provide visual indication of when the targets are active, i.e. when the bucket has bee filled with water so that hitting a target will cause the bucket to dump its contents. The status indicator may be configured to only light up when the system is 'ready' or 'active', or may be configured to light up in different colors according to the current status, e.g. 'green' for 'ready' or 'active', and 'red' for 'inactive'. The status indicator may be mounted in a hole in the cover plate 40 so as to be visible from both the front and rear of the upright frame portion for viewing by both participants. Alternatively, the indicator light(s) may be hidden from the second participant.

Figure 8:
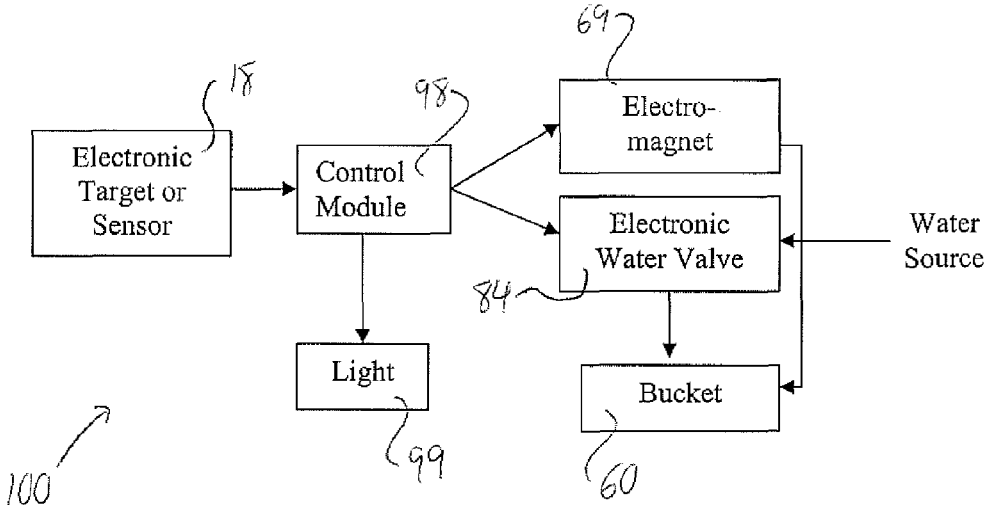
FIG. 8 is a schematic illustration of an electronic control system of the apparatus of FIG. 1.

FIG. 8 schematically illustrates an electronic control system 100 for the apparatus. To prepare the apparatus for use, the hose 92 is coupled to the valve 84. As outlined above, when the bucket is empty, the return spring ensures it is positioned in its default upright orientation, and so the bucket is suitably positioned for filling by the automatically fill/refill device. With the battery having been charged to a suitable level, or with mains power being employed, the control module 98 is powered up and initialized. The control module 98 may employ a programmable logic controller (PLC) or other microcontroller. The control module starts its routine by activating the electromagnet, which maintains the default upright condition of the bucket, and then opens the normally closed valve 84 for a predetermined duration of a time to convey a predetermined amount of water to the bucket. On expiry of this timer, the valve is returned to its default closed condition, at which time the status indicator is lit up to indicate that the apparatus is ready for use.

In this 'ready' state, the control module monitors for an output signal from either of the targets 18 in response to having been struck by a projectile, for example by monitoring for a change in an open/closed state of a pressure switch that is actuated out of its normal condition by impact of the target pad by the projectile. When either target is struck, the control module momentarily interrupts the supply of current to the normally-on electromagnet, thereby releasing the magnetic retention of the base plate to allow the automatic gravitational dumping of the bucket of water. The circuit to the electromagnet is then re-closed during or after the automatic return of the bucket to the upright position by the tension spring 80 to once again act on the bucket-carrying base plate. Upon the expiry of a timer initiated by the detected target strike, or by the resulting momentary disconnect of the electromagnet, the control module restarts the above routine, starting with the first step of opening the valve 84 to re-fill the bucket with a new charge of water.

The control module may employ an additional timer that limits the amount of time to sense a target strike before switching to an 'inactive' state in which the dumping device is not triggered even if a target is hit. This way, the system is arranged to have a preset or adjustable 'game length', where the first participant has only so long to try and hit one of the targets with a projectile before the game is over, and one or more new participants take the place of one or both of the previous participants so that the game timer can be restarted. In such embodiments, a start switch or button is preferably employed so that an operator of the game can initiate a new game, and may be an audible device that generates a sound upon the expiry of the game timer in order inform the operator and participants that the game has expired.

The illustrated apparatus is a portable unit that can be collapsed for storage or transport. Holes in the brackets 29 are provided for select alignment with holes or ball detent mechanisms on the feet 24 so that a locking pin can be engaged through aligned holes in the bracket and foot 24, or the ball detent of the foot 24 engaged in the hole of the bracket, to secure each foot in one of two locked positions. The illustrated feet 24 are shown in deployed horizontal positions perpendicular to the uprights 28 to lie on the ground and prevent tipping of the frame, but each foot is pivotally attached to its bracket 29 by a horizontal pivot pin lying in the cross-wise direction of the frame to allow pivoting of the foot upward from the deployed position into a stowed position lying parallel to the respective upright 28. Further collapse of the illustrated frame is allowed by use of telescopic sections in each upright. Lower tubular section 28*a* is larger in cross section than an upper tubular section 28*b* telescopically received in the lower section. The intermediate cross-members 32, 34, 36 connect the two lower sections 28*a* together, while the top cross member 30 connects the two upper sections 28*b* together. During use of the apparatus, locking pins or ball detents are used to secure the upper sections 28*b* in raised positions where their lower ends depend only partially into the lower sections 28*a*. When collapse of the frame is desirable, the viewing window cover 58 is fully or partially removed and the locked engagement of the upper and lower sections is released to allow the upper sections to slide further down into the lower sections, bringing the top cross-bar 30 down closer to the intermediate cross-bars to reduce the overall height of the apparatus.

The frame of the illustrated embodiment may be made of aluminum tubing to achieve a desirable strength to weight ratio, and the bucket and base plate for same may be made of stainless steel to withstand the repeated and frequent exposure to water over time. However, these are only examples, and other materials may be additionally or alternatively employed. The base plate may be made entirely of magnetically-attractable material, or may instead employ a magnetically attractable catch piece on the underside of a base plate of different material.

It will be appreciated that a water amusement apparatus may a feature a target blocking device operable by a participant regardless of whether the water-effect triggered by the targets is bucket dumping mechanism or some other device capable of dumping, spraying, misting, or otherwise conveying or propelling water; whether the water-effect is arranged to act on the same participant controlling the blocking mechanism or on another participant; whether the targets are arranged to electronically or mechanically trigger the water effect; and whether the blocking mechanism is mechanically or electronically controlled by the participant.

For example, electronic inputs operable by the second participant may be used to control a motorized blocking member. Where a purely mechanical blocking mechanism is used, it need not be limited to a pivotal blocking mechanism like that of the illustrated embodiment, as a slidable mounting of the central support arm 50 of the blocking mechanism may alternatively allow lateral back and forth displacement thereof. For example, referring to the drawings, if slot 42 were elongated to reach near each target, and the single blocking member 52 carried in alignment with the central support arm 50 was replaced with two blocking members carried laterally outward from the arm 50 on opposite sides thereof, sliding the arm back and forth in the slot could be used to allow selective blocking of the two targets one at a time. It will also be appreciated that movement of the blocking mechanism is not limited to purely horizontal movement between horizontally spaced targets. For example, a pivoting or sliding blocking mechanism could feature vertical movement of the mechanism for blocking vertically spaced targets, or combined horizontal and vertical movements between horizontally and vertically spaced targets.

The number of targets may also be varied. For example, a single target of multiple times the size of the blocking member could be used, requiring that the second participant attempt to block a portion of the target at which he/she believes the projectile will strike at is approaches. On the other hand, more than two targets could alternatively be employed, for example with additional targets positioned below the slot 42 of the illustrated embodiment.

It will also be appreciated that the details of the frame structure used to support the blocking, target and water effect devices may also be varied within the scope of the present invention. For example, alternate embodiments may not require that all of these devices be carried on a common framework, although this is a desirable feature for easy setup of a portable water amusement apparatus. Furthermore, just as a target blocking mechanism may be employed with water effects other than an electrically activated type, the described electromagnetic dumping mechanism may be employed for water amusement games other than a blocker-equipped target game. The container being dumped also need not be bucket-shaped, and may employ other arrangements featuring a discharge opening located above the bottom of a normally upright container being tipped by the mechanism. The target blocking mechanism or the electromagnetic dumping mechanism may be employed with projectile activated targets of types other than pressure switch configurations, and for example may be used with electronic targets or sensor based on proximity detection.

It will also be appreciated that the output action taken in response to hitting of a target need not involve the conveyance of water or other liquid. For example, a blocking mechanism of the present invention could be employed on a 'dunk tank' style amusement apparatus, where the successful strike of the target collapses a support board on which the second participant is seated over a tank of water or other liquid, thereby dropping the participant into the liquid. Other embodiments may lack a liquid of any sort, and for example, instead direct a stream or burst of pressurized air at the participant, with our without confetti or other soft material adding a visual element to the blast, or drop the participant into a tank lined with protective foam or filled with foam pieces or hollow light-weight balls to break the fall of the participant. In another embodiment, non-liquid material could be dumped or dropped on the participant. For example, the above described bucket-dumping apparatus is no limited to use with a liquid, and for example could be used to dump foam pieces or light-weight balls onto the participant from above.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. An amusement apparatus for use by at least two participants, the apparatus comprising:

at least one target device that comprises first and second target members and is arranged to provide an output in response to impact of either one of said first and second target members by a projectile launched by a first one of said participants;

an effect device arranged to be activated by the output of the target device to produce an output action having a physical effect on a second one of said participants;

a frame comprising an upright frame portion; and a blocking device comprising a support member movably mounted to the upright frame portion in a position passing from a rear side of said upright frame portion to an opposing front side of said upright frame portion, and a blocking member carried on the support member on the front side of the upright frame portion, the support member being movable by said second one of said participants from the rear side of the upright frame portion in order to move the blocking member between a first blocking position in front of the first target member and a second blocking position it front of the second target member, thereby enabling the second one of said participants to attempt to block the projectile from impacting either one of said first and second target members by movement of said blocking member into a respective one of said first and second blocking positions.

2. The apparatus of claim 1 wherein said first and second target members are mounted on the upright frame portion in positions facing outwardly therefrom to the front side of said upright frame portion.

3. The apparatus of claim 1 wherein the blocking device comprises an input member carried on the support member on the rear side of the upright frame portion to be manipulated by the second one of said participants, and the upright frame portion comprises a barrier positioned between the blocking member and the input member to protect the second one of said participants from the projectile when launched by the first one of said participants.

4. The apparatus of claim 3 wherein at least a portion of the barrier provides a viewing window through which the second one of said participants can visually monitor approach of the projectile.

5. The apparatus of claim 4 wherein the viewing window comprises a covering spanning across a frame of the window, the covering having openings sized to prevent passage of the projectile therethrough while allowing viewing through the covering.

6. The apparatus of claim 5 wherein the covering comprises a mesh material.

7. The apparatus of claim 3 wherein the effect device is arranged to provide the physical effect at a location on the rear side of the upright frame portion.

8. The apparatus of claim 1 wherein said effect device is mounted on the same frame as the blocking device.

9. The apparatus of claim 1 wherein the blocking device is pivotally mounted on the frame by a vertical pivot pin for horizontal movement of the blocking device about an axis of said pivot pin.

10. The apparatus of claim 1 wherein the target device comprises first and second switches respectively actuable to effect the output in response to contact of the first and second target members by the projectile.

11. The apparatus of claim 1 comprising an electronic control system coupled between the effect device and the target device, wherein the effect device comprises an electronically controlled dumping assembly comprising a container arranged to release contents therefrom under the output of the target device.

12. The apparatus of claim 11 wherein the container comprises a closed bottom and an opening positioned at a height above said closed bottom when the container is in a normal upright position, the output of the target device changing an electromagnet between on and off states to tilt the container out of the normal upright position into a dumping position releasing the contents of the container.

13. The apparatus of claim 12 wherein the electromagnet is arranged to maintain the container in its upright position when in the on state.

14. The apparatus of claim 13 wherein the container is gravitationally biased out of the upright position toward the dumping position when filled to at least a predetermined level.

15. The apparatus of claim 14 comprising a return spring arranged to bias the container toward the upright position.

16. The apparatus of claim 11 comprising a normally closed valve arranged for connection to a source of liquid and connected to the electronic control system to automatically fill the container with liquid content.

17. An amusement apparatus for use by at least two participants, the apparatus comprising:

at least one target device arranged to provide an output in response to impact of a target member of said target device by a projectile launched by a first one of said participants;

an effect device arranged to be activated by the output of the target device to produce an output action having a physical effect on a second one of said participants;

a frame comprising an upright frame portion; and a blocking device comprising a support member movably mounted to the upright frame portion in a position passing from a rear side of said upright frame portion to an opposing front side of said upright frame portion, and a blocking member carried on the support member on the front side of the upright frame portion, the support member being movable by said second one of said participants from the rear side of the upright frame portion in order to move the blocking member into and out of a blocking position in front of the target member, thereby enabling said second one of said participants to attempt to block the projectile from impacting said target member by movement of said blocking member into the blocking position.

* * * * *